US005486265A

United States Patent [19]

Salugsugan

[11] Patent Number: 5,486,265

[45] Date of Patent: Jan. 23, 1996

[54] CHEMICAL-MECHANICAL POLISHING OF THIN MATERIALS USING A PULSE POLISHING TECHNIQUE

[75] Inventor: Isidore Salugsugan, Fremont, Calif.

[73] Assignee: Advanced Micro Devices, Inc., Sunnyvale, Calif.

[21] Appl. No.: 383,737

[22] Filed: Feb. 6, 1995

[51] Int. Cl.[6] ..... H01L 21/304

[52] U.S. Cl. ..... 156/636.1; 216/88; 451/287

[58] Field of Search ..... 156/636.1; 216/88; 451/287, 288, 286, 285, 41, 42, 63; 437/228

[56] References Cited

U.S. PATENT DOCUMENTS 3,841,031 10/1974 Walsh .
3,911,562 10/1975 Youmans .
4,193,226 3/1980 Gill, Jr. et al. .
4,811,522 3/1989 Gill, Jr. .
4,944,836 7/1990 Beyer et al. .
5,069,002 12/1991 Sandhu ..... 451/287
5,081,795 1/1992 Tanaka ..... 451/288
5,245,794 9/1993 Salugsugan .

*Primary Examiner*—Sam Silverberg

[57] ABSTRACT

Uniform chemical-mechanical planarization is achieved at a high material removal rate by pulsing the pressure applied to the wafer undergoing planarization between an initial optimum pressure and a reduced second pressure, preferably about 0 psi.

16 Claims, 2 Drawing Sheets

CHEMICAL-MECHANICAL POLISHING OF THIN MATERIALS USING A PULSE POLISHING TECHNIQUE

TECHNICAL FIELD

The present invention relates a chemical-mechanical polishing method to effect a high removal rate of material and uniform planarization of a surface on a wafer during the manufacture of a semiconductor device. The invention has particularly application in rapidly planarizing thin films of dielectric material.

BACKGROUND ART

Semiconductor integrated circuits are manufactured by forming an array of separate dies on a common semiconductor wafer. During processing, the wafer is treated to form specified regions of insulating, conductive and semiconductor type materials. The ever increasing requirements for high density devices comprising wiring patterns with increasingly smaller distances between conductive lines, coupled with increasing economic pressures for reduced production time and increased throughout, pose a significant technological challenge. Conventionally, a wiring pattern comprising a dense array of conductive lines is formed by depositing a metal layer and etching to form a conductive pattern. A dielectric is then applied to the wiring pattern and planarization is effected as by chemical-mechanical polishing. However, it is extremely difficult to planarize layers with high removal rates of material, particularly with dense arrays of conductive lines separated by distances of less than 0.5 micron.

Chemical-mechanical polishing is a conventional technique employed to planarize a patterned insulating layer or a patterned metallic layer. For example, as shown in FIG. 1, during an initial processing stage for forming an integrated circuit, a pattern 110 is formed on layer 120 of, for example, an insulating material, a conductive material such as a metal, or a semiconductor substrate having an interwiring spacing 130 and trench 140. The object is to completely fill the interwiring spacing 130 and trench 140 with a subsequently deposited material 100 as, for example, an insulating material if pattern 110 is a conductive pattern. After layer 100 is deposited, it must be planarized to obtain a uniformly planarized surface 150 as shown in FIG. 2 wherein line numerals denote like components. Planarization is conventionally effected by plasma etching, or by a simplified faster and relatively inexpensive method known as chemical-mechanical planarization or polishing (CMP). CMP is a conventional technique as disclosed in, see for example, Salugsugan, U.S. Pat. No. 5,245,794 which shows using a slurry to polish a semiconductor wafer; Beyer et al., U.S. Pat. No. 4,944,836; Youmans, U.S. Patent No. 3,911,562. See also U.S. Pat. Nos. 4,193,226 and 4,811,522 to Gill, Jr. and U.S. Pat. No. 3,841,031 to Walsh which relate to CMP apparatus.

Basically, in employing a conventional CMP apparatus, wafers to be polished are mounted on polishing blocks which are placed on the CMP machine. A polishing pad is adapted to engage the wafers carried by the polishing blocks. A cleaning agent is dripped onto the pad continuously during the polishing operation while pressure is applied to the wafer.

A typical CMP apparatus 300 is shown in FIG. 3 and comprises a rotatable polishing platen 302, polishing pad 304 mounted on platen 302, which are driven by microprocessor control motor (not shown) to spin at about 25 to about 50 RPM. Wafer 306 is mounted on the bottom of a rotatable polishing head 308 so that a major surface of wafer 306 to be polished is positionable to contact the underlying polish pad 304. Wafer 306 and polishing head 308 are attached to a vertical spindle 310 which is rotatably mounted in a lateral robotic arm 312 which rotates the polishing head 308 at about 15 to about 30 RPM in the same direction as platen 302 and radially positions the polishing head. Robotic arm 312 also vertically positions polishing head 308 to bring wafer 306 into contact with polishing head 304 and maintain an appropriate polishing contact pressure. A tube 314 opposite polishing head 308 above polishing pad 304 dispenses and evenly saturates the pad with an appropriate cleaning agent 316, typically a slurry.

In employing conventional CMP techniques and apparatus such as that depicted in FIG. 3, it is difficult to obtain in a uniformly planarized surface at a high removal rate of material undergoing planarization, particularly of a high density wiring pattern with interwire spacings of less than about 0.5 microns covered with a dielectric material.

The problem of achieving uniform planarization at a high removal rate of material utilizing conventional CMP techniques and apparatus is recognized in the semiconductor industry. Previous attempts to solve this problem focus upon improvements in the consumable materials employed during CMP, such as the polishing pad and cleaning agent, or improvements in the hardware itself, such as the CMP apparatus. These prior efforts have proved less than satisfactory.

DISCLOSURE OF THE INVENTION

An object of the present invention is a CMP method for uniformly planarizing a surface on a wafer at a high removal rate of material.

Additional objects, advantages and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

According to the present invention, the foregoing and other objects are achieved in part by a method of manufacturing a semiconductor device, wherein a surface of a wafer is planarized comprising chemical-mechanical polishing the surface to effect planarization while applying a first pressure to the wafer and intermittently reducing the first pressure to a second pressure a plurality of times during chemical-mechanical processing.

Another aspect of the invention is an improvement in a conventional method of chemical-mechanical polishing a surface of a wafer to effect planarization during manufacturing of a semiconductor device, wherein the wafer is placed on a polishing pad, a cleaning agent applied to the polishing pad, pressure applied to the wafer, the improved comprising intermittently reducing the pressure during chemical-mechanical polishing a plurality of times.

Additional objects and advantages of the present invention will become readily apparent to those skilled in this art from the following detailed description, wherein only the preferred embodiment of the invention is shown and described, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE INVENTION

Figure 1:
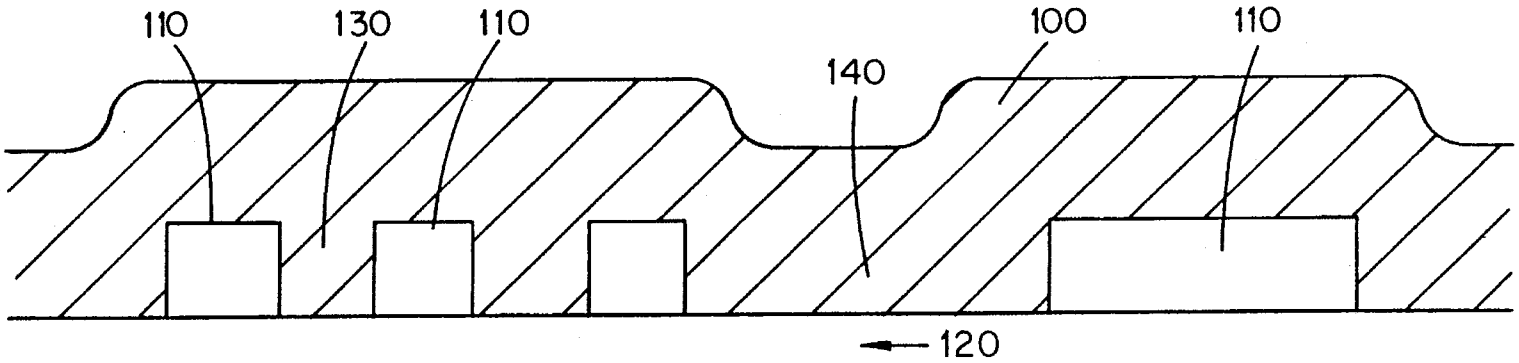
FIG. 1 illustrate a layer of material deposited on a patterned material.

The present invention addresses the limitations of conventional CMP technology in achieving uniformly planarized surfaces of materials, particularly dielectric materials, at high removal rates. The inability of conventional CMP technology to achieve high polishing rates constitutes a serious economic impediment. Time consuming CMP decreases production throughput, consumes man hours and exhausts large amounts of cleaning agent and other consumable materials. The lack of a uniformly planarized surface adversely affects the reliability of the resulting semiconductor device, particularly in devices comprising multi-level vias wherein the upper vias would be overetched to insure complete etching at the lower levels.

The present invention addresses and solves such limitations of conventional CMP technology, i.e., methodology and apparatus, by selecting an appropriate initial pressure applied to wafer undergoing CMP and intermittently reducing the initial pressure to a second pressure a plurality of times during the course of CMP processing. I discovered that during the course of CMP processing, the surface to be polished in contact with the polishing pad becomes depleted in cleaning agent, which adversely affects the polishing rate and uniformity of the CMP operation, since incomplete polishing occurs in depleted areas, as toward the center of the wafer. In accordance with my invention, the initial pressure applied to the wafer undergoing CMP is intermittently reduced creating a pulsing pressure, thereby enabling the cleaning agent, which is normally continuously applied to the polishing pad, to continuously reach all portions of the surface of the wafer undergoing polishing throughout the entire CMP operation. Thus, the periodic reduction of pressure applied to the wafer during CMP processing eliminates the negative impact of starvation areas, i.e., areas which do not have a sufficient amount of cleaning agent.

The present invention can be practiced employing otherwise conventional CMP technology, i.e., techniques and apparatus. For example, the CMP apparatus disclosed in the previously mentioned Gill, Jr. or Walsh patents can be employed in the practice of the present invention. A commercially available CMP apparatus which can be employed in the present invention is Model 372 Polish and manufactured by Westex Systems, Inc., of Phoenix, Ariz. or Strasbaug, San Luis Opisbo, Calif. Model 6DFSP form. The polishing pad employed in the claimed invention can be any of those which are conventionally employed in CMP, such as those comprising a cellular polyurethane pad, preferably about 50 mills thick. The cleaning agent employed in the claimed invention can be any of those conventionally employed in CMP processing. In a preferred embodiment, a slurry, most preferably a slurry comprising potassium hydroxide and particulate silica, is employed, a conventional polishing slurry.

In practicing the present invention, an optimum initial pressure is selected to obtain effective removal of material at an economically desirable high rate of speed, typically between about 6 and about 9 psi. In accordance with present invention, the second or reduced pressure is generally less than about 2 psi, preferably less than about 1 psi, preferably about 0 psi. The polishing speed or rotations of the polishing pad is generally between about 20 and about 50 RPM.

Figure 2:
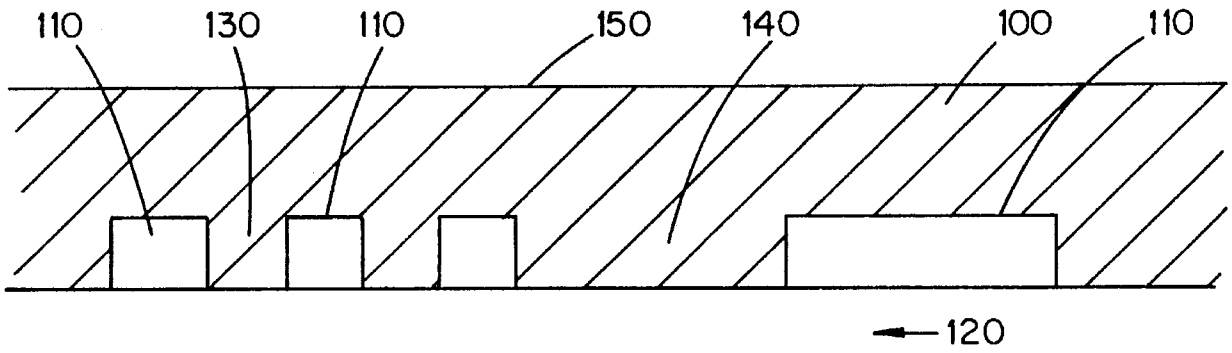
FIG. 2 illustrates the planarized deposited layer of FIG. 1.
Figure 3:
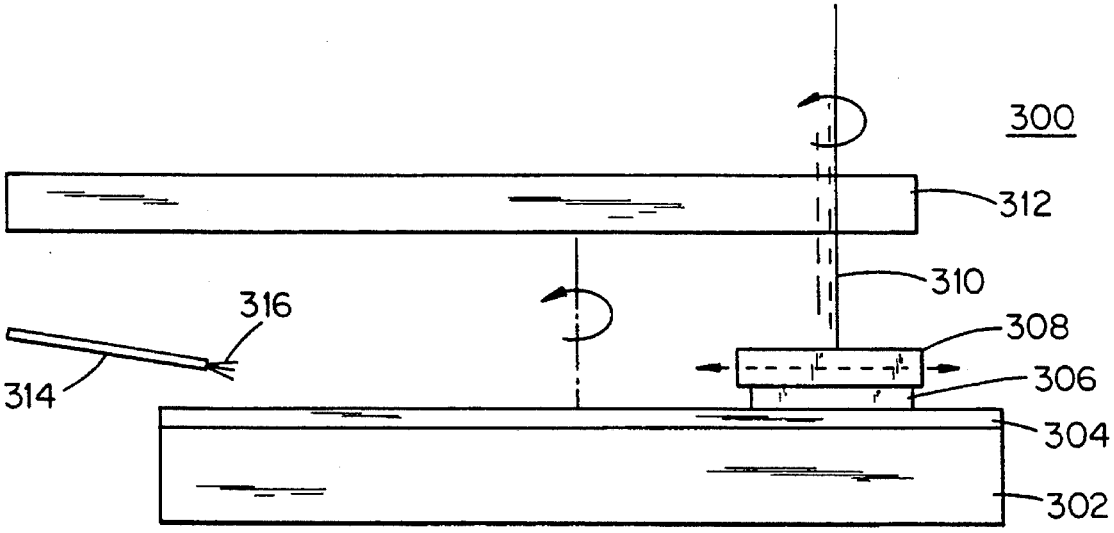
FIG. 3 schematically illustrates a typical chemical-mechanical polishing machine.

The improved CMP technique of the present invention can be employed to planarize various types of surfaces on a wafer, including conductive and insulating materials, such as oxides, tetraethyl orthosilicate, also referred to as tetraethoxysilane (TEOS), nitrides, polysilicon, single crystalline silicon, amorphous silicon, and mixtures thereof. Preferably, a dielectric layer, such as TEOS, is deposited on a conductive pattern and planarized in accordance with the claimed invention in a manner similar to that generally schematically illustrated in FIGS. 1 and 2. The substrate of the wafer containing the conductive or non-conductive material is generally a semiconductor material, such as silicon.

In conducting the present inventive method, the first pressure is intermittently reduced to the second pressure during the course of CMP. The frequency of reducing the initial pressure depends upon each particular CMP operation, e.g., the particular CMP apparatus, speed of polishing, materials undergoing planarization and cleaning agent. Preferably, the first pressure is reduced to the second pressure about every 1 to 15 seconds, preferably about every 1 to 10 seconds, most preferably about every 1 to 5 seconds. In a most preferred embodiment, the first pressure is intermittently reduced to the second pressure about every 1 to 3 seconds.

By the present invention, the speed and uniformity of planarization effected by conventional CMP technology is greatly improved by virtue intermittently reducing the pressure applied to the wafer undergoing planarization from an optimum initial pressure, preferably to about 0 psi. The inventive pulse CMP technique is applicable to a wide variety of situations which require planarization during the course of manufacturing a semiconductor device.

Only the preferred embodiment of the invention and but a few examples of its versatility are shown and described in the present disclosure. It is to be understood that the invention is capable of use in various other combinations and environments and is capable of changes or modifications within the scope of the inventive concept as expressed herein.

I claim:

1. A method of manufacturing a semiconductor device wherein a surface on a wafer is planarized, comprising:

placing the wafer to be planarized on a polishing pad;

applying a polishing slurry to the polishing pad;

chemical-mechanical polishing the surface to effect planarization while applying a first pressure to the wafer; and intermittently reducing the first pressure to a second pressure a plurality of times during chemical-mechanical polishing to reduce starvation.

2. The method according to claim 1, wherein the first pressure is about 6 to about 9 psi, and the second pressure is less than about 2 psi.

3. The method according to claim 2, wherein the second pressure is less than about 1 psi.

4. The method according to claim 3, wherein the second pressure is about 0 psi.

5. The method according to claim 1, wherein the surface of the wafer comprises an insulating material.

6. The method according to claim 5, wherein the insulating material is selected from the group consisting of an oxide, nitride, and mixtures thereof.

7. The method according to claim 6, wherein the insulating material is TEOS.

8. The method according to claim 6, wherein the insulating material is silicon dioxide.

9. The method according to claim 1, wherein the surface of the wafer comprises a material selected from the group consisting of an oxide, nitride, polysilicon, single crystalline silicon, amorphous silicon, and mixtures thereof.

10. The method according to claim 1, wherein the substrate comprises silicon.

11. The method according to claim 1, wherein the first pressure is intermittently reduced to the second pressure about every 1 to 15 seconds during chemical-mechanical polishing.

12. The method according to claim 11, wherein the first pressure is intermittently reduced to the second pressure about every 1 to 10 seconds.

13. The method according to claim 12, wherein the first pressure is intermittently reduced to the second pressure about every 1 to 5 seconds.

14. The method according to claim 13, wherein the first pressure is intermittently reduced to the second pressure about every 1 to 3 seconds.

15. The method according to claim 1, wherein the polishing pad comprises a fibrous polymer.

16. The method according to claim 4, wherein the slurry comprises potassium hydroxide and particular silica.

* * * * *